US008345886B2

(12) United States Patent
Park

(10) Patent No.: US 8,345,886 B2
(45) Date of Patent: Jan. 1, 2013

(54) METHOD AND APPARATUS FOR DETECTING MALFUNCTIONING SPEAKER

(75) Inventor: Kyu-eun Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1384 days.

(21) Appl. No.: 12/015,537

(22) Filed: Jan. 17, 2008

(65) Prior Publication Data

US 2009/0028349 A1 Jan. 29, 2009

(30) Foreign Application Priority Data

Jul. 25, 2007 (KR) ..... 10-2007-0074622

(51) Int. Cl.
*H04R 29/00* (2006.01)

(52) U.S. Cl. ..... 381/59; 381/96

(58) Field of Classification Search ..... 381/59, 381/96, 400, 83
See application file for complete search history.

(56) References Cited

U.S. PATENT DOCUMENTS

| | | | | |
|---|---|---|---|---|
| 4,723,292 | A * | 2/1988 | Taylor | 381/56 |
| 6,975,734 | B1 * | 12/2005 | Suzuki | 381/121 |
| 2004/0008848 | A1 * | 1/2004 | Krochmal et al. | 381/55 |
| 2005/0163326 | A1 * | 7/2005 | Heuer | 381/59 |
| 2006/0126857 | A1 * | 6/2006 | Pavlov et al. | 381/59 |

FOREIGN PATENT DOCUMENTS

| | | | |
|---|---|---|---|
| GB | 2390908 | A | 1/2004 |
| JP | 2004-159244 | A | 6/2004 |

* cited by examiner

*Primary Examiner* — Minh-Loan T Tran
*Assistant Examiner* — Fazli Erdem
(74) *Attorney, Agent, or Firm* — Sughrue Mion, PLLC

(57) ABSTRACT

A method and apparatus for detecting a malfunctioning speaker are provided. The apparatus detects a speaker abnormality by identifying the state of the speaker when turning the power on or off, switching from standby mode to play mode, or performing testing. The apparatus generates an audio signal having a frequency higher than a particular frequency, outputs the audio signal to the speaker, and determines that the speaker is malfunctioning if the level of a fed-back frequency signal is lower than a reference level. If the speaker is determined to be malfunctioning, the power supply is cut and the danger of a fire starting is accordingly reduced.

14 Claims, 4 Drawing Sheets

METHOD AND APPARATUS FOR DETECTING MALFUNCTIONING SPEAKER

CROSS-REFERENCE TO RELATED APPLICATIONS

This application claims priority under 35 U.S.C. §119 from Korean Patent Application No. 10-2007-0074622, filed on Jul. 25, 2007 in the Korean Intellectual Property Office, the disclosure of which is incorporated herein by reference in its entirety.

BACKGROUND OF THE INVENTION

1. Field of the Invention

Apparatuses and methods consistent with the present invention relate to detecting a malfunctioning speaker, and more particularly, to determining whether a speaker is functioning properly or malfunctioning.

2. Description of the Related Art

Audio apparatuses process audio signals received from an external source or audio signals stored in recording media, and output sounds corresponding to the audio signals using a speaker. In general, audio apparatuses include a home theater, a television, a radio, a mobile phone and the like.

FIG. 1 is a block diagram illustrating a related art audio apparatus. With reference to FIG. 1, the audio apparatus includes a digital amplifier 110 which converts an audio signal into a pulse-width-modulation (PWM) signal and amplifies the signal, and a low pass (LC) filter 120 which performs LC-filtering high frequency components of the amplified PWM signal and outputs an analog audio signal to one or more speakers 130.

A sensor 140 senses the state of the digital amplifier 110, and a controller 150 turns off the apparatus if the sensor 140 senses that the digital amplifier 110 is in an abnormal state, such as excessive current or voltage, low voltage, abnormal temperature, and so on.

The frequency response of the digital amplifier 110 is determined according to the performance of the LC filter 120, and the LC filter 120 relates to the impedance of the speakers 130.

In general, the speakers 130 have an impedance of 4-8Ω, and general home audio apparatuses use speakers having an impedance of 8Ω. The LC filter 120 is designed to stabilize the frequency response of an audio frequency band in the impedance of the speakers 130.

FIG. 2 is a waveform showing the frequency response curve of an LC filter optimized to a general speaker having an impedance of 8Ω. As shown in FIG. 2, the audio frequency band 20 Hz-20 kHz has output frequency response at a regular level.

FIG. 3 is a waveform showing the frequency response of an LC filter when an impedance of 1Ω is connected to the LC filter optimized to a general speaker having an impedance of 8Ω. In FIG. 3, the frequency response in a high frequency area of 1 kHz-20 kHz is degraded. That is, the frequency response in a high frequency area of the LC filter 120 is affected by the impedance of the speakers 130.

In the related art audio apparatus, there is a method for preventing damage to the digital amplifier 110 by the sensor 140 sensing abnormalities in the digital amplifier 110. However, there is no method for protecting the speaker 130, which is more expensive than the digital amplifier 110.

For example, if the output of the digital amplifier 110 exceeds the rating, or a DC level is output, the speaker is not damaged within a short period of time but is slowly damaged over a long period of time. Accordingly, although the user may not notice the deterioration of the sound, the impedance of the speakers 130 is reduced but the output of the digital amplifier 110 is regular, so speakers 130 may occasionally catch fire due to overload.

Therefore, there is a need for methods to sense the state of the speaker 130.

SUMMARY OF THE INVENTION

Exemplary embodiments of the present invention address the above problems and/or disadvantages and other disadvantages not described above. Also, the present invention is not required to overcome the disadvantages described above, and an exemplary embodiment of the present invention may not overcome any of the problems described above.

The present invention provides a method and apparatus for sensing the state of a speaker and detecting a malfunctioning speaker.

According to an exemplary aspect of the present invention, there is provided a method for detecting a malfunctioning speaker, the method including generating a frequency signal for detecting a speaker abnormality, outputting the frequency signal to the speaker, and feeding back the frequency signal, and detecting a speaker abnormality based on the fed-back frequency signal.

The frequency signal is a signal having a frequency corresponding to a high frequency in an audio frequency band, or a signal having a higher frequency than the audio frequency band.

The feeding back comprises differentially amplifying the frequency signal, and filtering a predetermined frequency band of the amplified frequency signal, wherein the predetermined frequency band is a frequency band of the frequency signal.

The fed-back frequency signal is fed back in an input terminal of the speaker.

In the detecting, if the level of the fed-back frequency signal is lower than a reference level, the speaker is determined to be malfunctioning.

The reference level is an output level corresponding to the frequency band of the frequency signal in the frequency response optimized for the impedance of the speaker.

The frequency signal is played when turning the power on or off, switching from standby mode to play mode, or performing testing.

According to an exemplary aspect of the present invention, there is provided an apparatus including a play unit which generates a frequency signal for detecting a speaker abnormality, and outputs the frequency signal to the speaker, a feedback unit which is connected to an input terminal of the speaker, and feeds back the played frequency signal, and a control unit which detects a speaker abnormality based on the fed-back frequency signal.

The frequency signal is a signal having a frequency corresponding to a high frequency in an audio frequency band, or a signal having a higher frequency than the audio frequency band.

The feedback unit comprises a differential amplifying unit which differentially amplifies the frequency signal, and a filter unit which filters a predetermined frequency band of the amplified frequency signal, wherein the predetermined frequency band is a frequency band of the frequency signal.

The control unit determines that the speaker is malfunctioning if the level of the fed-back frequency signal is lower than a reference level.

The reference level is an output level corresponding to the frequency band of the frequency signal in the frequency response optimized for the impedance of the speaker.

The control unit operates the play unit to play the frequency signal when turning power on or off, switching from standby mode to play mode, or performing testing.

The play unit comprises an amplifying unit which converts the frequency signal into a PWM signal and amplifies the PWM signal, and a low pass filter unit which filters high frequency components of the amplified PWM signal.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF EXEMPLARY EMBODIMENTS OF THE INVENTION

Figure 1:
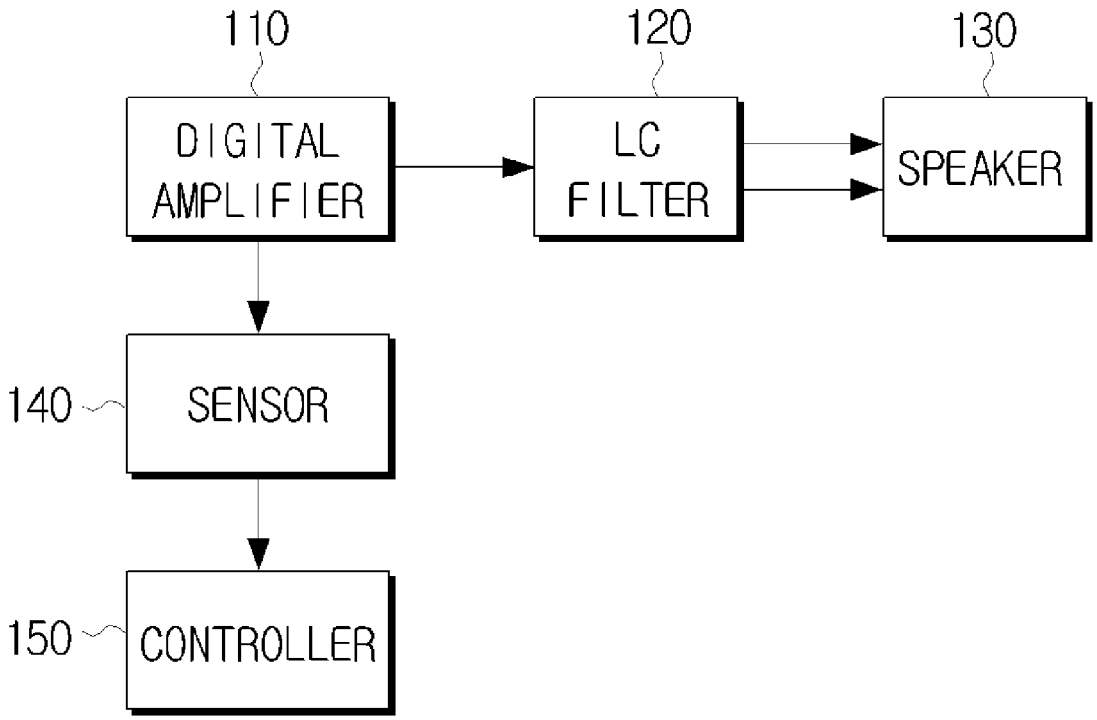
FIG. 1 (RELATED ART)
FIG. 1 is a block diagram illustrating a general audio apparatus.

Certain exemplary embodiments of the present invention will now be described in greater detail with reference to the accompanying drawings.

In the following description, same drawing reference numerals are used for the same elements even in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the invention with unnecessary detail.

Figure 4:
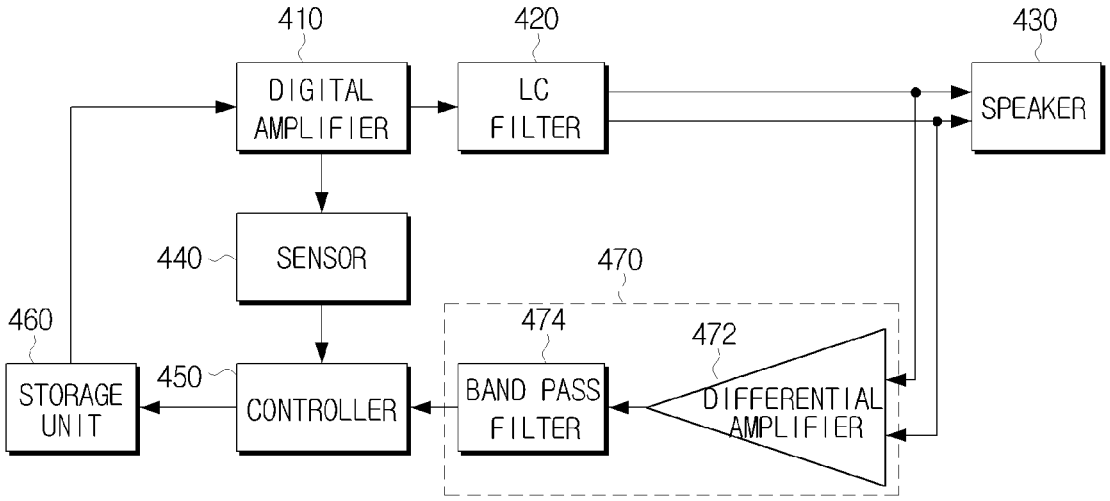
FIG. 4 is a block diagram illustrating an apparatus according to an exemplary embodiment of the present invention.

FIG. 4 is a block diagram illustrating an apparatus according to an exemplary embodiment of the present invention.

The apparatus identifies the state of a speaker 430 when turning on/off the apparatus, switching mode, or testing, and determines whether the state of the speaker 430 is functioning properly or malfunctioning. In this case, the apparatus generates an audio signal having a frequency higher than a particular frequency to detect the state of the speaker 430.

With reference to FIG. 4, the apparatus includes a digital amplifier 410, a low pass (LC) filter 420, the speaker 430, a sensor 440, a controller 450, a storage unit 460, and a feedback unit 470.

The digital amplifier 410 and the LC filter 420 constitute a play unit for generating an analog audio signal. In particular, the digital amplifier 410 converts an audio signal into a pulse-width-modulation (PWM) signal and amplifies the signal. The LC filter 420 performs LC-filtering of high frequency components of the amplified PWM signal and outputs an analog audio signal to the speaker 430.

The speaker 430 oscillates an oscillator (not shown) according to the analog audio signal and outputs sound.

The sensor 440 senses whether abnormalities, such as excessive current, excessive voltage, low voltage, or abnormal temperature, occur in the digital amplifier 410, and notifies the controller 440 of the abnormality if the abnormality is sensed. If the sensor 440 senses the abnormality of the digital amplifier 410, the controller 450 cuts off the power supply to the apparatus.

In order to detect the state of the speaker 430, the controller 450 operates the digital amplifier 410 and the LC filter 420 to process a frequency signal stored in the storage unit 460. The frequency signal stored in the storage unit 460 may be a signal having a frequency of 10 kHz-20 kHz which corresponds to a high frequency band in audio frequency band, or may be a signal having a frequency higher than the audio frequency.

The sampling frequency used in general audio apparatuses is 48 kHz, but it is difficult to play a signal having a frequency higher than the audio frequency band. However, as the digital amplifier 410 can perform over-sampling to 96 kHz, a signal having a frequency of 30 kHz-40 kHz can be also played.

The digital amplifier 410 converts the frequency audio signal output from the storage unit 460 into a PWM signal, and amplifies and outputs the signal. The LC filter 420 filters high frequency components of the amplified PWM signal and outputs an analog audio signal.

The feedback unit 470 is connected to an input terminal of the speaker 430, and feeds back the signal output from the LC filter 420 to the controller 450. The feedback unit 470 includes a differential amplifier 472, and a band pass filter 474.

The differential amplifier 472 amplifies and outputs the difference of a signal output from the LC filter 420. The differential amplifier 472 feeds back two signals output from the LC filter 420 and converts them into a single signal if the digital amplifier 410 is designed in a balanced transformerless (BTL) manner, and outputs the two signals positive (+) and negative (−). Accordingly, if the digital amplifier 410 outputting a single signal is provided, the differential amplifier 472 may not be used.

The band pass filter 474 filters a particular frequency band of the signal amplified by the differential amplifier 472, and outputs the filtered signal to the control unit 450. The particular filtered frequency band is a frequency band of the signal stored in the storage unit 460.

If a frequency band used in the apparatus is limited, the band pass filter 474 may be replaced with a high pass filter or a low pass filter.

The controller 450 determines that the speaker 430 is malfunctioning if the level of the signal output from the band pass filter 474 is lower than a reference level, and determines that the speaker 430 is functioning properly if the level of the signal output from the band pass filter 474 is higher than the reference level. The reference level is an output level corresponding to the frequency of the signal stored in the storage unit 460 in the frequency response optimized the impedance of the speaker 430.

If the speaker 430 is determined to be malfunctioning, the controller 450 cuts off the power supply. That is, sound is not output from the speaker 430, and the user can thus realize that the speaker is malfunctioning.

Figure 5:
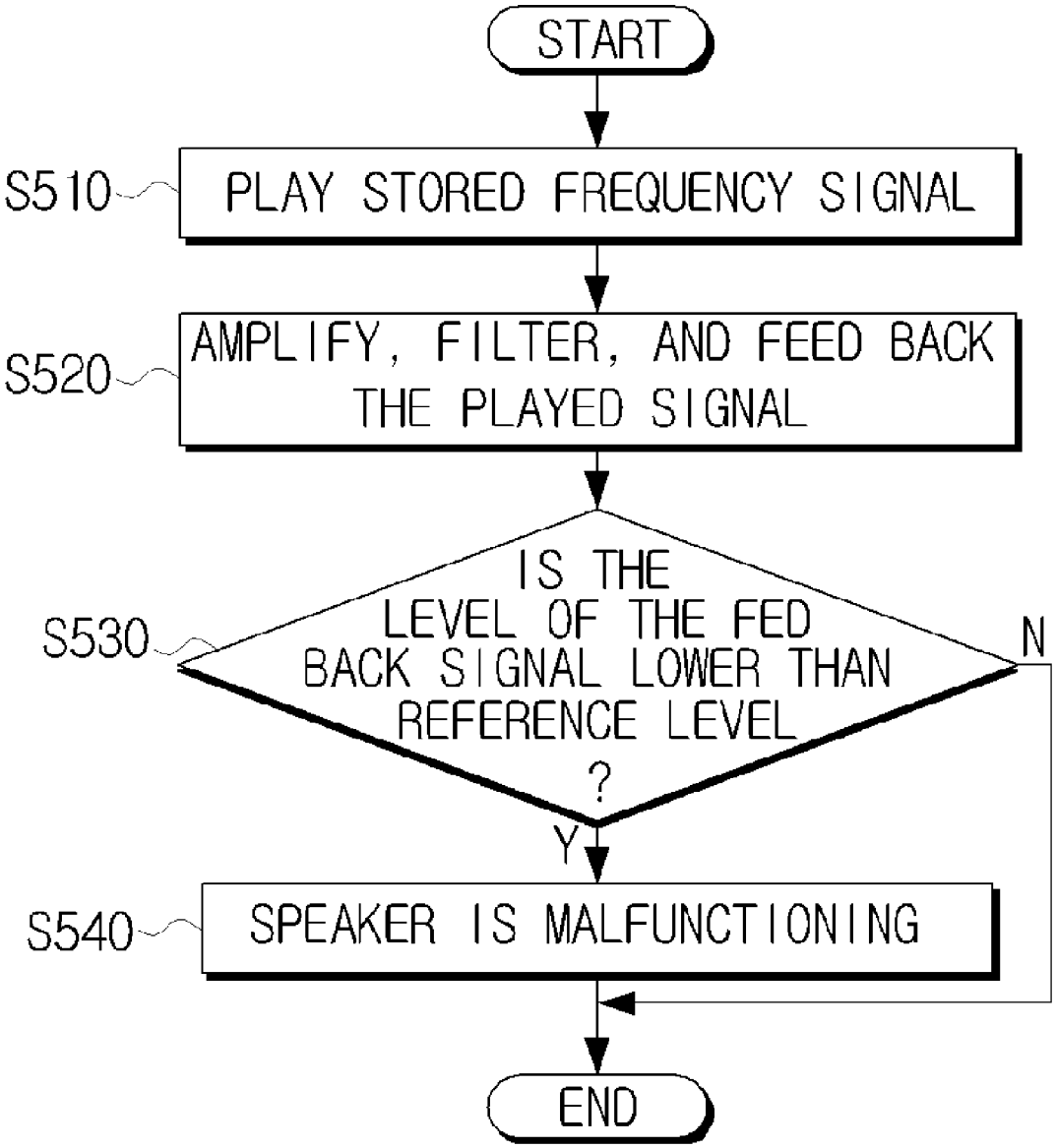
FIG. 5 is a flow chart illustrating a method for detecting a malfunctioning speaker according to an exemplary embodiment of the present invention.

FIG. 5 is a flow chart illustrating a method for detecting a malfunctioning speaker according to an exemplary embodiment of the present invention.

With reference to FIG. 5, in operation S510, the controller 450 operates the digital amplifier 410 and the LC filter 420 to play a frequency signal stored in the storage unit 460. The controller 450 identifies the state of the speaker 430 when turning the apparatus on or off, switching from standby mode to play mode, or performing testing.

In operation S520, the differential amplifier 472 and the band pass filter 474 amplify and filter the signal output from the LC filter 420, and feed back the filtered and amplified signal to the controller 450.

Figure 2:
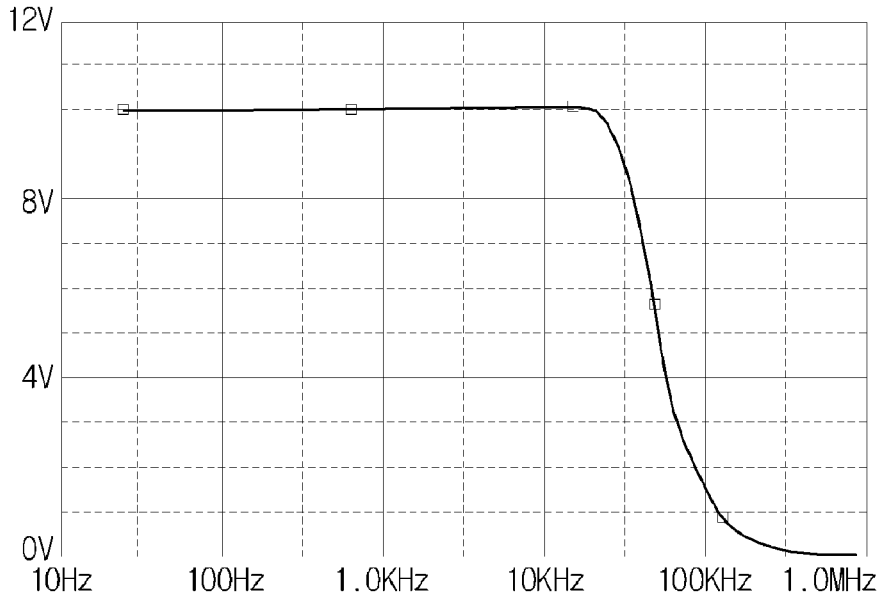
FIG. 2 (RELATED ART)
FIG. 2 is a waveform showing the frequency response of an LC filter optimized to a general speaker having an impedance of 8Ω.
Figure 3:
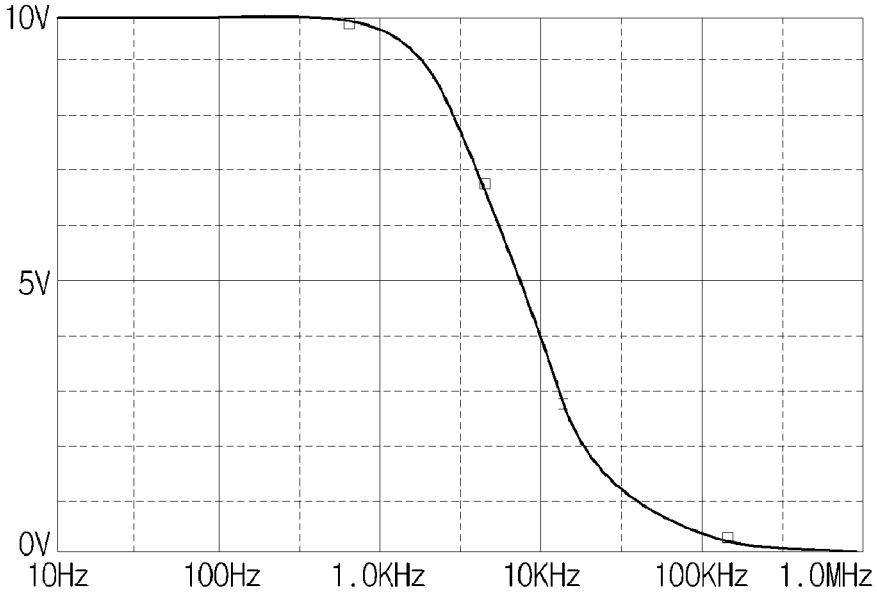
FIG. 3 (RELATED ART)
FIG. 3 is a waveform showing the frequency response of an LC filter when an impedance of 1Ω is connected to the LC filter optimized to a general speaker having an impedance of 8Ω.

In operation S530, the controller 450 determines whether the level of the fed-back signal is lower than the reference level. For example, it is assumed that the speaker 430 has an impedance of 8Ω, and the frequency signal stored in the storage unit 460 is 20 kHz. With reference to the frequency response of FIG. 2, the output level in 20 kHz is 10 V. That is, if the level of the fed-back signal is lower than 10 V, the controller 450 determines that the speaker 430 is malfunctioning.

In operation S540, if the level of the fed-back signal is determined to be lower than the reference level, the controller 450 determines that the speaker 430 is malfunctioning. In the above embodiment, if the speaker 430 is malfunctioning, the controller 450 cuts off the power supply. However, the controller 450 may be implemented to display "the speaker is malfunctioning" using an on-screen display (OSD).

Moreover, in the exemplary embodiment, the case of using the digital amplifier is described as an example. However, also in the case that an analog amplifier is used, speaker abnormalities can be detected using a voice coil inside the speaker.

Furthermore, if the frequency signal to detect speaker abnormalities is in an audio frequency band, sound is generated when detecting speaker abnormalities. Accordingly, if an apparatus which plays a melody when the apparatus is turned on/off detects speaker abnormalities when the apparatus is turned on/off, the sound generated to detect speaker abnormalities can be replaced with the melody.

The apparatus as described above may be adopted in an audio/video (A/V) device for providing users with moving images, or in an audio device for outputting audio using a speaker. Representative examples of the A/V device are broadcast reception apparatuses such as televisions and set-top boxes, plasma display panels (PDPs), portable multimedia players (PMPs), and the like.

As can be appreciated from the above description, speaker abnormalities can be easily determined by identifying the state of the speaker whenever particular operations are performed. If the speaker is determined to be abnormal, the power supply is cut off and the danger of a fire starting is thus reduced.

In addition, as speaker abnormalities can be determined in manufacturing, the possibility of distributing poor speakers in the market place is reduced, resulting in monetary gains and improved image of the manufacturer.

The foregoing exemplary embodiments and advantages are merely exemplary and are not to be construed as limiting the present invention. The present teachings can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A method for detecting a malfunctioning speaker, the method comprising:

generating a frequency signal for detecting a speaker abnormality;

inputting the frequency signal to a speaker;

feeding back the frequency signal which is input to input terminals of the speaker; and detecting an abnormality of the speaker based on the voltage level of the fed-back frequency signal, wherein the feeding back the frequency signal comprises filtering a predetermined frequency band of the frequency signal, and wherein the predetermined frequency band is a frequency band of the frequency signal.

2. The method of claim 1, wherein the frequency signal is a signal having a frequency corresponding to a high frequency in an audio frequency band, or a signal having a higher frequency than the audio frequency band.

3. The method of claim 1, wherein the feeding back the frequency signal further comprises:

differentially amplifying the frequency signal; and filtering a predetermined frequency band of the frequency signal comprises filtering a predetermined frequency band of the amplified frequency signal.

4. The method of claim 1, wherein the fed-back frequency signal is fed back from an input terminal of the speaker.

5. The method of claim 1, wherein in the detecting, if the level of the fed-back frequency signal is lower than a reference level, the speaker is determined to be malfunctioning.

6. The method of claim 5, wherein the reference level is an output level corresponding to a frequency band of the frequency signal in a frequency response optimized for an impedance of the speaker.

7. The method of claim 5, wherein the frequency signal is generated if power is turned on or off, switching from a standby mode to a play mode, or performing testing.

8. An apparatus comprising:

a play unit which generates a frequency signal that is output to a speaker;

a feedback unit which is connected to input terminals of the speaker, and feeds back the frequency signal; and a controller which detects an abnormality of the speaker based on the voltage level of the fed-back frequency signal, wherein the feedback unit comprises a filter which filters a predetermined frequency band of the frequency signal, and wherein the predetermined frequency band is a frequency band of the frequency signal.

9. The apparatus of claim 8, wherein the frequency signal is a signal having a frequency corresponding to a high frequency in an audio frequency band, or a signal having a higher frequency than the audio frequency band.

10. The apparatus of claim 8, wherein the feedback unit further comprises:

a differential amplifier which differentially amplifies the frequency signal; and wherein the filter filters a predetermined frequency band of the amplified frequency signal wherein the predetermined frequency band is a frequency band of the frequency signal.

11. The apparatus of claim 8, wherein the control unit determines that the speaker is malfunctioning if the level of the fed-back frequency signal is lower than a reference level.

12. The apparatus of claim 11, wherein the reference level is an output level corresponding to a frequency band of the frequency signal in a frequency response optimized for an impedance of the speaker.

13. The apparatus of claim 8, wherein the control unit operates the play unit to generate the frequency signal if power is turned on or off, switching from a standby mode to a play mode, or performing testing.

14. The apparatus of claim 8, wherein the play unit comprises:

an amplifying unit which converts the frequency signal into a pulse-width-modulation (PWM) signal and amplifies the PWM signal; and a low pass filter unit which filters high frequency components of the amplified PWM signal.

* * * * *